US009694948B1

(12) United States Patent
Pakhomov et al.

(10) Patent No.: US 9,694,948 B1
(45) Date of Patent: Jul. 4, 2017

(54) CLOSURE DEVICE FOR BOTTLE

(71) Applicant: INOSTRANNOJE PROIZVODSTVENNOE UNITARNOJE PREDPRIYATIE "ALCOPACK", Gomel (BY)

(72) Inventors: Dmitry Ivanovich Pakhomov, Gomel (BY); Jaroslav Valerievich Zochtchouk, Gomel (BY)

(73) Assignee: INOSTRANNOJE PROIZVODSTVENNOE UNITARNOJE PREDPRIYATIE "ALCOPACK", Gomel (BY)

( * ) Notice: Subject to any disclaimer, the term of this patent is extended or adjusted under 35 U.S.C. 154(b) by 0 days.

(21) Appl. No.: 15/173,319

(22) Filed: Jun. 3, 2016

(51) Int. Cl.
*B65D 41/38* (2006.01)
*B65D 41/34* (2006.01)

(52) U.S. Cl.
CPC ..... *B65D 41/38* (2013.01)

(58) Field of Classification Search
CPC B65D 41/38; B65D 41/3419; B65D 41/3442; B65D 41/3457; B65D 41/3476; B65D 41/349
USPC ..... 215/334, 358, 203, 253, 252, 230, 258
See application file for complete search history.

(56) References Cited

U.S. PATENT DOCUMENTS 3,685,677 A * 8/1972 Westfall ..... B65D 41/0457 215/230
5,131,549 A * 7/1992 Battegazzore ..... B65D 41/38 215/252
6,439,411 B1 * 8/2002 Schwarz ..... B65D 41/3419 215/252
6,981,600 B1 * 1/2006 Battegazzore ..... B65D 41/3442 215/230
8,281,944 B2 * 10/2012 Battegazzore ..... B65D 41/3428 215/219
2002/0070236 A1 * 6/2002 Wolf ..... B65D 41/3419 222/153.05
2004/0060891 A1 * 4/2004 Nishida ..... B65D 41/3438 215/252
2006/0113272 A1 * 6/2006 Rodriguez ..... B65D 41/3419 215/252
2014/0138380 A1 * 5/2014 Fox ..... B65D 50/046 220/214
2015/0298876 A1 * 10/2015 McPherson ..... B65D 41/348 215/200

FOREIGN PATENT DOCUMENTS

RU 50206 U1 12/2005
UA 13328 U 3/2006

* cited by examiner

*Primary Examiner* — J. Gregory Pickett
*Assistant Examiner* — Niki M Eloshway
(74) *Attorney, Agent, or Firm* — Marshall, Gerstein & Borun LLP

(57) ABSTRACT

The closure device for bottle comprises an inner sleeve with locking means on the bottle, a cover with tear-off element, coupled to the inner sleeve, wherein said cover is connected with the tear-off element by a weakened section. The inner sleeve is a hollow cylindrical element with open butt ends, outer projections are formed on the lower part of the sleeve and the tear-off element is formed with inner projections for coupling with the outer projections of the sleeve. The inner sleeve comprises an annular element arranged on its inner surface which can provide additional visual tamper-evident through the outer side surface of the inner sleeve.

9 Claims, 2 Drawing Sheets

CLOSURE DEVICE FOR BOTTLE

The invention relates to a closure device for containers, preferably, such as bottles containing high-quality alcoholic beverages. Such devices must be equipped with bottle tamper-evident means and means preventing re-closure of the bottle by this closure device without such an indication.

Similar closure devices with bottle tamper-evident means are known, among which the following are the closest.

A closure cap for a container is known comprising an outer sleeve with locking means on the container positioned at the bottom part of said sleeve and outer projections at its middle portion arranged along its perimeter, and an inner sleeve inserted in the outer sleeve and coupled with the outer cover. The outer cover includes a tear-off element, coupled through inner projections with the outer projections of the outer sleeve. The outer cover is connected to the tear-off element by a weakened section (Ukraine patent No 13328, published on 15 Mar. 2006).

The disadvantage of the known analog is the relative complexity of the design due to the presence of both the outer sleeve which is used for coupling with container's locking ring and with the tear-off element, and the inner sleeve, which is used for coupling with the outer cover. Also, positioning of the locking means on the container does not allow usage of similar cap for container's locking ring, as locking means of the cap are positioned at the upper part of the locking ring, closer to its pouring opening.

The closure cap for container comprising an inner sleeve with locking means on the container, an outer cover with a tear-off element coupled to the inner sleeve, wherein the outer cover is connected with the tear-off element by a weakened section (utility model patent RU 50206 U1 published on 27 Dec. 2005) is adopted as a prototype. The inner sleeve is formed as a cylindrical detail with an internal thread which interacts with the thread on the outer surface of the container's locking ring. At the same time, the upper butt end of the sleeve is made closed and comprises a sealing ring on the inner surface coupled to the pouring opening of the container. Also, the tear-off element in the lower part of the outer cover is coupled to the container's locking ring by means of the lower edge bended over the lower portion of annular projection on the outer surface of the container's locking ring.

The prototype has a fairly simple design, which also facilitates its assembly. A disadvantage of the prototype is the insufficiently reliable locking of the tear-off element on the container's locking ring, which may lead to its turning-through together with the outer cover when it is rotated to open the container. Also, provision of tamper-evident only through separation of the tear-off element from the outer cover when the weakened section is destroyed and its positioning on the locking ring below the closure cap is not sufficiently informative in terms of tamper-evident.

The object of the invention is to simplify the design of the closure device maintaining sealing integrity of the closure and ensuring double tamper-evident bottle.

The object is achieved in that the closure device for bottle comprises an inner sleeve with locking means on the locking ring of the bottle, a cover with tear-off element coupled to the inner sleeve, wherein said cover is connected with the tear-off element by a weakened section. The inner sleeve is a hollow cylindrical element with open butt ends, outer projections are formed on the lower part of the sleeve and the tear-off element is formed with inner projections for coupling with the outer projections of the sleeve. The inner sleeve comprises an annular element arranged on its inner surface which can provide additional visual tamper-evident through the outer side surface of the inner sleeve.

Preferably, the inner sleeve is entirely or partially transparent in order to insure the visibility of the annular element after the opening.

Preferably, the annular element is made partly or fully colored. The annular element may also comprise identification means, visible after the opening.

Preferably, the annular element is coupled to the inner sleeve by means of adhesive or tight fit.

Preferably, the annular element and sleeve may be made as a single piece by two-component color molding.

Preferably, the cover comprises a separate sealing element coupled to the inner butt end of the cover. The cover also can be made with an annular sealing projection.

Preferably, the cover of the closure device has support means, which interact with the abutment surface of the butt end of the inner sleeve to restrict axial fit of the cover on said sleeve at a certain height.

Preferably, the inner projections of the tear-off element and outer projections of the inner sleeve are formed as opposingly positioned teeth.

An example embodiment of the closure device according to the invention and description of its operation are presented below. The description is illustrated by graphic materials which show the following:

Figure 1:
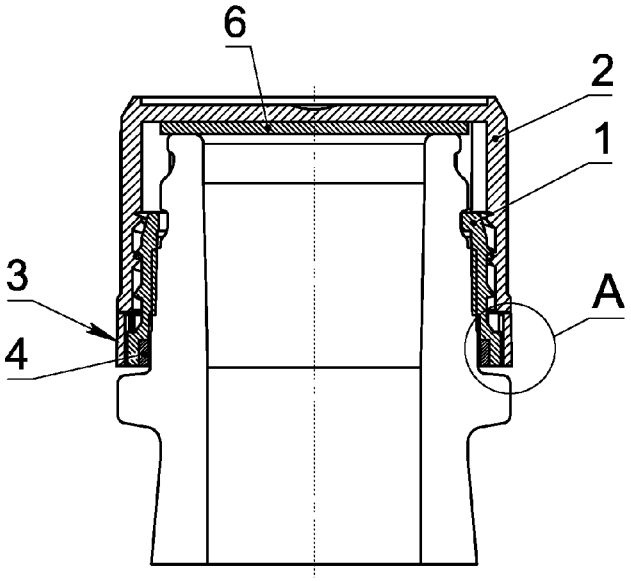
FIG. 1 is a general sectional view of the closure device in assembly with a separate sealing element.
Figure 2:
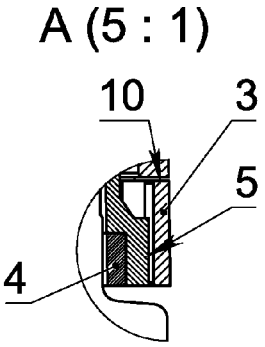
FIG. 2 is a view of A of FIG. 1.

Presented examples and drawings do not limit the embodiments of the device according to the invention, but merely illustrate it.

The closure device for bottle comprises an inner sleeve 1 with locking means on the bottle and cover 2 with a tear-off element 3 coupled to the inner sleeve 1. A colored annular element 4 is placed on the inner surface of the inner sleeve 1.

The inner sleeve 1 is designed as a hollow cylindrical element with open butt ends with locking means on the locking ring of the bottle in radial and axial direction (not shown in the drawings). There are outer projections 5 at the bottom part of the inner sleeve 1 and there is an annular element 4 on the inner surface of said sleeve, which can be fixed thereon through adhesive or tight fit, for example, in an annular groove.

Figure 3:
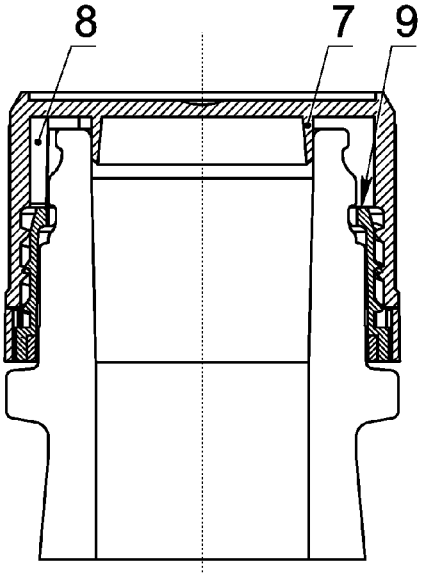
FIG. 3 is a general sectional view of the closure device with an annular sealing projection.
Figure 4:
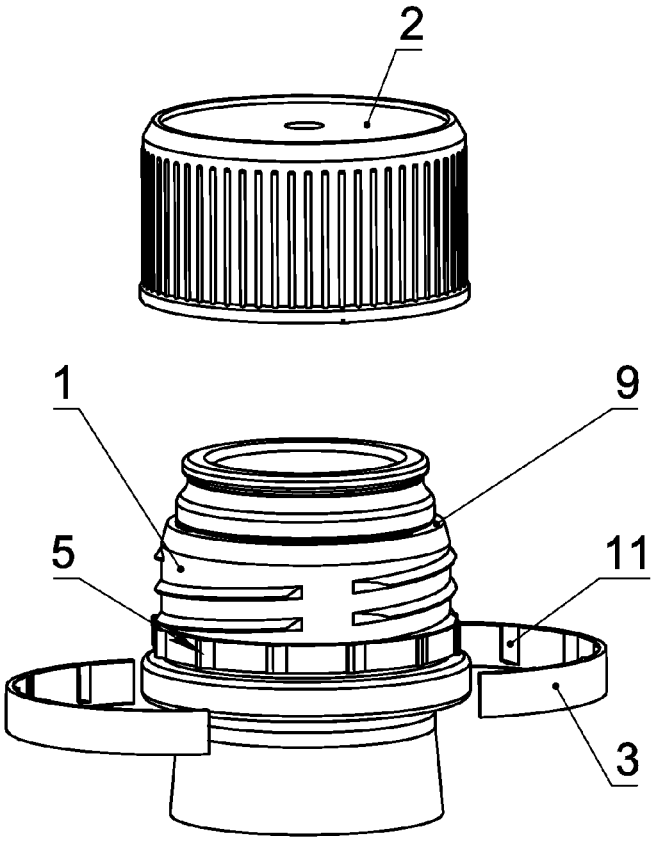
FIG. 4 is a general view of the device after the first opening.
Figure 5:
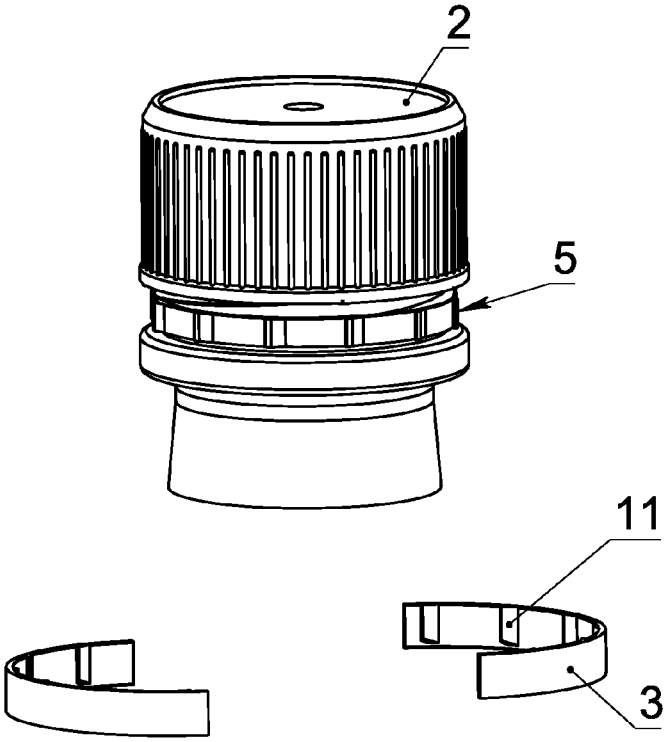
FIG. 5 is a general view of the device—re-closed.

The outer cover 2 is transparent and can contain a gasket 6 (FIG. 1) coupled to its inner butt end or annular sealing 7 (FIG. 3) formed on its inner butt end. Also, support means 8 are formed on the inner surface of the cover 2 which interact with the abutment surface of the butt end 9 of the inner sleeve 1. The coupling of the cover 2 and inner sleeve 1 can be made, for example, threaded. The support means 8 can be made, for example, in the form of longitudinal ribs.

The outer cover 2 is connected with the tear-off element 3 by a weakened section 10. The tear-off element 3 is located in the lower part of the outer cover 2 and is formed with inner projections 11 for coupling with the outer projections 5 of the inner sleeve 1 located in its lower part. Inner projections 11 of the tear-off element 3 and outer projections 5 in the lower part of the sleeve 1 can be in the form of opposingly positioned inclined teeth. The tear-off element 3 can be formed as a ring having at least one part divided at the area of tear by a weakened section.

The closure device according to the present invention is assembled to form one piece. First of all, the annular element 4 is attached to the inner lower surface of the inner sleeve 1, and then the sleeve 1 is installed in the cover 2 with the tear-off element 3 along the thread until it is stopped by the support means 8 of the cover 2 by snapping. The support means 8 of the cover 2 interact with the abutment surface of the butt end 9 of the inner sleeve 1, with a possibility to restrict axial fit of the cover on said sleeve at a certain height. At the same time, the inner projections 11 of the tear-off element 3 are positioned between the outer projections 5 in the lower part of the sleeve 1.

The closure device, assembled in this way, is ready to be installed on the locking ring of the bottle.

The closure device with the described above design is used as follows.

When closing the bottle, the inner sleeve 1 is rigidly fixed on the locking ring of the bottle in radial and axial direction. At the same time, the gasket 6 is in contact with the butt end, thus, sealing the bottle closed with the claimed device. As an embodiment, the sealing can be achieved by means of entering the annular projection 7 in the pouring opening of the locking ring of the bottle.

In order to open the bottle the outer cover 2 is rotated using its lateral surface. When rotating the outer cover 2, the inner projections 11 of the tear-off element 3 engage with the outer projections 5 of the sleeve 1, not allowing the simultaneous rotation of the tear-off element 3 and the outer cover 2. During further rotation of the outer cover 2 and its upward movement due to the threaded coupling with the inner sleeve 1, the tear-off element 3 is separated from the outer cover 2 by breaking the weakened section, thus, indicating the opening of the bottle. The inner sleeve 1 remains on the locking ring of the bottle with the annular element 4, and its outer projections 5 are visually visible even in case of re-screwing the cover 2 on the inner sleeve 1. Moreover, the tear-off element 3 also cannot be re-fixed to the cover 2, which prevents re-closure of the bottle using this device without indication about its first opening.

Producing the sleeve 1 of a transparent material and the annular element 4 colored partially or fully provides an additional visual indication of opening.

The annular element 4 can also comprise identification means in the form of letters, words or other symbols, which also become visible after opening.

In addition, the annular element 4 and sleeve 1 can be made as a single piece by two-component color molding.

The proposed closure device can be made as one unit including all of the above mentioned parts, or it can be transported separately in order to be installed on a bottle.

The closure of the bottle with such device is performed by pressing in downward direction using a closure machine.

Thus, the proposed technical solution makes it possible to simplify the design of the closure device maintaining sealing integrity of the closure while ensuring double tamper-evident bottle and inability to reuse the closure device.

What is claimed is:

1. Closure device for bottles comprising:

inner sleeve with locking means on a locking ring of the bottle, cover with tear-off element coupled to the inner sleeve, the cover is connected with the tear-off element through a weakened section, the inner sleeve is a hollow cylindrical element with an inner open butt end and an outer open butt end, outer projections are formed on the lower part of the inner sleeve, the tear-off element is made with inner projections which can couple with the outer projections of the inner sleeve, the inner sleeve comprises an annular element arranged on an inner surface which can provide additional visual tamper-evident through an outer side surface of the inner sleeve, and the inner sleeve being entirely or partially transparent to provide visibility of the annular element after opening.

2. Closure device according to claim 1, characterized in that the annular element is made partly or fully colored.

3. Closure device according to claim 1, characterized in that the annular element also comprises identification means, which are visible after opening.

4. Closure device according to claim 1, characterized in that the annular element is coupled to the inner sleeve by means of adhesive or tight fit.

5. Closure device according to claim 1, characterized in that the annular element and the inner sleeve constitute one monolithic element.

6. Closure device according to claim 1, characterized in that the cover comprises a separate sealing element coupled to the inner open butt end of the cover.

7. Closure device according to claim 1, characterized in that the cover is provided with an annular sealing projection.

8. Closure device according to claim 1, characterized in that the cover has support means which interact with an abutment surface of the inner open butt end of the inner sleeve making it possible to restrict the axial fit of the cover on said sleeve at a certain height.

9. Closure device according to claim 1, characterized in that the inner projections of the tear-off element and outer projections of the inner sleeve are formed as opposingly positioned teeth.

* * * * *